US005946400A

United States Patent [19]

Matsuo

[11] Patent Number: 5,946,400

[45] **Date of Patent: *Aug. 31, 1999**

[54] THREE-DIMENSIONAL SOUND PROCESSING SYSTEM

[75] Inventor: Naoshi Matsuo, Kawasaki, Japan

[73] Assignee: Fujitsu Limited, Kawasaki, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/808,648

[22] Filed: Feb. 28, 1997

[30] Foreign Application Priority Data

Aug. 29, 1996 [JP] Japan ..... 8-227933

[51] Int. Cl.[6] ..... H04R 5/00

[52] U.S. Cl. ..... 381/17; 381/61; 381/1

[58] Field of Search ..... 381/17, 18, 24, 381/1, 61, 309, 310

[56] References Cited

U.S. PATENT DOCUMENTS

| | | | |
|---|---|---|---|
| 4,308,423 | 12/1981 | Cohen | 381/1 |
| 5,337,363 | 8/1994 | Platt | 381/61 |
| 5,386,082 | 1/1995 | Higashi | 381/1 |
| 5,412,731 | 5/1995 | Desper | 381/1 |
| 5,596,644 | 1/1997 | Abel et al. | 381/17 |

FOREIGN PATENT DOCUMENTS 7-231705 3/1997 Japan .

*Primary Examiner*—Vivian Chang
*Attorney, Agent, or Firm*—Staas & Halsey

[57] ABSTRACT

A three-dimensional sound processing system which provides a listener with three-dimensional sound effects by reproducing a sound image properly positioned in a reproduced sound field. A filter coefficient enhancement unit creates two difference-enhanced impulse responses by emphasizing the difference between two sets of acoustic characteristics pertaining to a listener's both ears, which are represented as impulse responses measured in an original sound field. Based on the two difference-enhanced impulse responses, a series of coefficients of a sound image positioning filter are determined for every possible location of the sound source. A coefficient memory unit stores various sets of such filter coefficients separately for each sound source location. The sound image positioning filter configures itself with the series of filter coefficients retrieved from the coefficient memory unit according to a given sound source location, and adds the acoustic characteristics of the original sound field to a source sound signal. The sound image positioning filter also subtracts in advance the acoustic characteristics of the reproduced sound field from the source sound signal, using a separate set of coefficients representing inverse characteristics of the reproduced sound field.

9 Claims, 17 Drawing Sheets

THREE-DIMENSIONAL SOUND PROCESSING SYSTEM

BACKGROUND OF THE INVENTION

1. Field of the Invention

The present invention relates to three-dimensional sound processing systems, and more specifically, to a three-dimensional sound processing system which provides a listener with three-dimensional sound effects by reproducing a sound image properly positioned in a reproduced sound field.

2. Description of the Related Art

To precisely recreate sound images, or to achieve accurate acoustic image positioning, it is necessary in general for sound processing systems to acquire acoustic characteristics both in the original sound field, where original sound signals are recorded, and in a reproduced sound field reproduced from the recorded sound signals. The characteristics of an original sound field are expressed by what is known as a head-related transfer function (HRTF), which represents relationships between sound signals produced by a sound source and those heard by a listener. The reproduced sound field involves some audio output devices such as speakers and headphones, which have some specific acoustic characteristics. Those characteristics of the original and reproduced sound fields are measured in advance with an appropriate procedure and programmed into the sound processing systems.

When outputting the recorded source sound signals in the reproduced sound field, the sound processing system adds the acoustic characteristics measured in the original sound field to those source sound signals. The system also subtracts, in advance, the acoustic characteristics of the reproduced sound, field from the source sound signals. Using speakers or headphones, listeners can hear the processed sound, where the recreated sound images are positioned right at the sound source locations in the original sound field.

FIG. 14 shows an example of an original sound field, in which a single sound source (S) 101 and a listener 102 are involved. As seen in this FIG. 14, there are two spatial sound paths from the sound source (S) 101 to each tympanic membrane of the left (L) and right (R) ears of the listener 102, whose acoustic characteristics are expressed by their respective head-related transfer function $S_L$ and $S_R$.

FIG. 15 shows an example of a reproduced sound field which is produced by a conventional sound processing system using a headphone consisting of a pair of earphones. Two filters 103 and 104 with a transfer function ($S_L$, $S_R$) will add to the entered sound signals some acoustic characteristics concerning the sound paths from the sound source 101 to the listener 102, which are previously measured in the original sound field. The other two filters 105 and 106, on the other hand, will subtract from the sound signals the acoustic characteristics of sound paths from earphones 107*a* and 107*b* to both ears of a listener 108, which are represented by a transfer function (h, h). Thus the filters 105 and 106 have the inverse transfer function of (h, h), namely, ($h^{-1}$, $h^{-1}$).

Input signals, carrying a sound information identical to the original sound from the sound source 101, are separated into the left and right channels and fed to the above-described filters 103–106. A sound image 109 reproduced by the earphones 107*a* and 107*b* will sound to the listener 108 as if it were placed at just the same location as the sound source 101 shown in FIG. 14.

The filters 103–106 are implemented as finite impulse response (FIR) filters, each comprising, as shown in FIG. 16, a plurality of delay units ($Z^{-1}$) 110–112 each made up with several flip-flops or the like, a plurality of multipliers 113–116, a summation unit 117, and an adder 118. Multiplier coefficients aO-an given to the respective multipliers 113–116 are obtained from the acoustic characteristics, or impulse response, of each spatial sound path. To obtain the coefficients for the filters ($S_L$, $S_R$) 103 and 104, the impulse responses should be measured for two spatial sound paths in the original sound field as illustrated in FIG. 14. To determine the coefficients for the FIR filters ($h^{-1}$, $h^{-1}$) 105 and 106, it is necessary to measure the impulse responses of two spatial sound paths from the earphones 107*a* and 107*b* to both tympanic membranes of the listener 108. Then their respective inverse responses should be computed. More specifically, the impulse responses of the two spatial sound paths from the headphones 107*a* and 107*b* to the listener's both tympanic membranes are measured and transformed into frequency domain, where their respective inverse functions are calculated. The calculated inverse functions are then reconverted into time domain to yield the filter coefficients.

Such conventional three-dimensional sound processing systems, however, have some shortcomings in their ability to position the sound image, as will be clarified as follows.

The human hearing system generally shows low sensitivity in locating a sound source in the vertical and front-to-rear directions, while exhibiting excellent ability in the side-to-side direction. Therefore, the listener would use visual information to locate a sound source in the front-to-rear direction or attempt to detect it by turning his/her head to the right or left to cause some difference in sound perception.

In the case where the listener is not in the original sound field but in a reproduced sound field, it is not possible to use visual information because there is no visual image of the original sound source. Even if the listener turns his/her head while wearing a headphone, it will cause no change in the acoustic characteristics of the reproduced sound field. Also, when speakers are used to recreate a sound field, the reproduced sound field is programmed assuming that a listener's head is oriented at a prescribed azimuth angle, and thus the rotation of his/her head will violate this assumption.

Therefore, in conventional three-dimensional sound processing systems, it is difficult to achieve effective positioning of a sound image in the front-to-rear direction with respect to a listener.

The applicant of the present invention proposed a three-dimensional sound processing system in the Japanese Patent Application No. Hei 7-231705 (1995). According to this patent application, the system computes appropriate filter coefficients that approximately represent poles (or peaks) and zeros (or dips) in an amplitude spectrum as part of the frequency-domain representation of an impulse response measured in the original sound field. Using such coefficients, it is possible to form infinite impulse response (IIR) filters and FIR filters with fewer taps to add the acoustic characteristics of the original sound field to the reproduced sound field. This filter design technique will reduce the amount of data to be processed by the filters and also enable miniaturization of memory circuits required in the filters. The use of such reduced-tap filters, however, does not always provide sufficient sound image positioning capability in the front-to-rear direction.

Meanwhile, conventional sound processing systems adjust the amplitude and reverberation of sounds to control the distance perspective of a sound image. To adjust reverberation, the systems are equipped with FIR filters having coefficients corresponding to an impulse response representing reverberation. Those FIR filters, however, have to process a large amount of data, which consumes a lot of memory, in order to achieve a desired performance.

Conventional sound processing systems also vary the loudness and pitch of a sound to allow the listener to feel the motion of a sound image. They simulate the Doppler effect by appropriately controlling the pitch of the sound. That is, a raised pitch expresses a sound source that is coming close to the listener, while a lowered pitch represents a sound source that is leaving the listener. To change the pitch of the sound, conventional sound processing systems employ a ring buffer 119 as illustrated in FIG. 17, which provides a predetermined amount of memory to temporarily store the sound data. The ring buffer 119 is equipped with a write pointer to generate a new memory address at a constant operating rate, thereby writing sound data into consecutive memory addresses. The ring buffer 119 also has a read pointer to provide a memory address for reading out the sound data, whose operating rate is controlled according to the required pitch of the sound. That is, the read pointer must operate faster to obtain a higher pitch, and slower to yield a lower pitch, thus changing the frequency of a sound signal.

This ring buffer 119, however, has a potential problem of overflowing or underflowing. When the sound image is rapidly approaching the listener, the read pointer will move much faster than the write pointer moves, to create a higher pitch to simulate the Doppler effect. Just similar to this, when the sound image is rapidly leaving the listener, the read pointer will move much slower than the write pointer moves. As a result, the read pointer will overtake the write pointer, or vise versa. To prevent this extreme case from happening, the ring buffer 119 must have enough memory capacity, which increases the cost of sound processing systems.

SUMMARY OF THE INVENTION

Taking the above into consideration, an object of the present invention is to provide a three-dimensional sound processing system which enables improved positioning of a sound image.

Another object of the present invention is to provide a three-dimensional sound processing system which enables the distance perspective and motion of a sound image to be controlled with lighter data processing loads and less memory consumption.

To accomplish the above objects, according to the present invention, there is provided a three-dimensional sound processing system which offers three-dimensional sound effects to a listener by reproducing a sound image properly positioned in a reproduced sound field.

This sound processing system comprises enhancement means, memory means, and a sound image positioning filter. The enhancement means creates two difference-enhanced impulse responses by emphasizing a difference between two sets of acoustic characteristics represented as impulse responses which are measured in an original sound field, concerning two spatial sound paths starting from a sound source and reaching the listener's left and right tympanic membranes. The memory means determines a series of filter coefficients for each location of the sound source, based on the two difference-enhanced impulse responses created by the enhancement means. The memory means stores a series of filter coefficients for each location of the sound source. The sound image positioning filter is configured with the series of filter coefficients retrieved from the memory means according to a given sound source location. The sound image positioning filter adds the acoustic characteristics of the original sound field to a source sound signal and removes the acoustic characteristics of the reproduced sound field from the source sound signal.

The sound processing system also comprises distance calculation means, coefficient decision means, and a low-pass filter. The distance calculation means calculates the distance between the sound image and the listener in the reproduced sound field. The coefficient decision means determines coefficients to be used in the low-pass filter, according to the distance calculated by the distance calculation means. Configured with the coefficients determined by the coefficient decision means 5, the low-pass filter suppresses the high-frequency components contained in the source sound signal.

Furthermore, the system comprises motion speed calculation means, another coefficient decision means, and a filter. The motion speed calculation means calculates the motion speed and direction of the sound image, based on variations in time of the distance calculated by the distance calculation means. The coefficient decision means determines the coefficients for the filter, according to the motion speed and direction which are calculated by the motion speed calculation means. The filter, configured with the coefficients determined by the coefficient decision means, suppresses the high-frequency components or low-frequency components contained in the source sound signal.

The above and other objects, features and advantages of the present invention will become apparent from the following description when taken in conjunction with the accompanying drawings which illustrate preferred embodiments of the present invention by way of example.

DESCRIPTION OF THE PREFERRED EMBODIMENTS

Several embodiments of the present invention will be described below with reference to the accompanying drawings.

Figure 1:
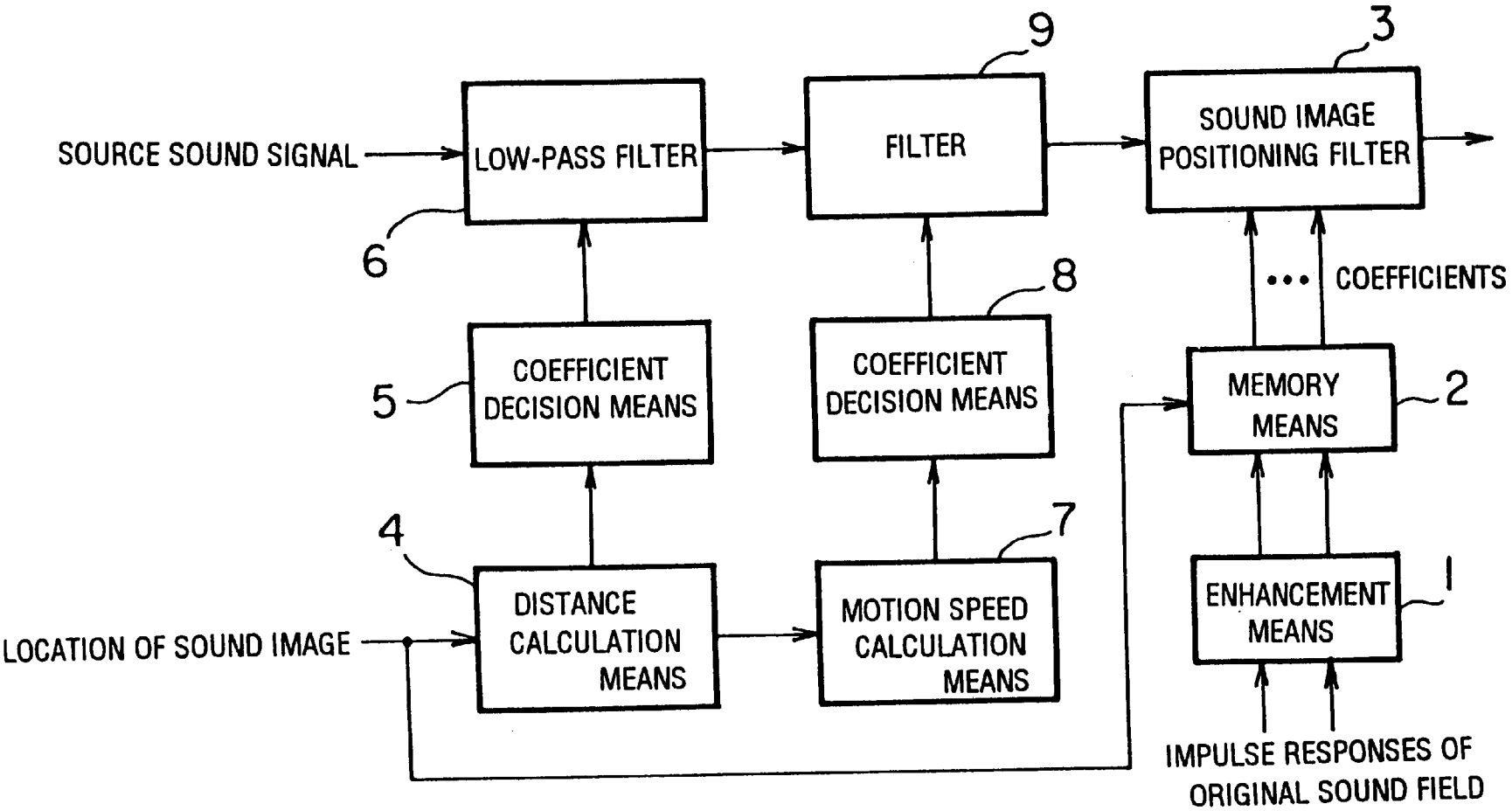
FIG. 1 is a conceptual view of a three-dimensional sound processing system according to the present invention.

Referring first to FIG. 1, the following description will present the basic concept of a first embodiment of the present invention. This first embodiment provides such a sound processing system that offers three-dimensional sound effects to a listener by reproducing a sound image properly positioned in a reproduced sound field.

As its primary elements, the system comprises enhancement means 1, memory means 2, and a sound image positioning filter 3. The enhancement means 1 creates two difference-enhanced impulse responses by emphasizing a difference between two sets of acoustic characteristics concerning two spatial sound paths starting from a sound source and reaching the listener's left and right tympanic membranes. Those characteristics in an original sound field are measured as impulse responses. The memory means 2 determines a series of filter coefficients for each location of the sound source, based on the two difference-enhanced impulse responses created by the enhancement means 1. The memory means 2 stores such a series of filter coefficients for each location of the sound source. The sound image positioning filter 3 is configured with the series of filter coefficients retrieved from the memory means 2 according to a given sound source location. The sound image positioning filter 3 adds the acoustic characteristics of the original sound field to a source sound signal and removes the acoustic characteristics of the reproduced sound field from the source sound signal.

The sound processing system also comprises distance calculation means 4, coefficient decision means 5, and a low-pass filter 6. The distance calculation means 4 calculates the distance between the sound image and the listener in the reproduced sound field. The coefficient decision means 5 determines coefficients of the low-pass filter 6, according to the distance calculated by the distance calculation means 4. Configured with the coefficients determined by the coefficient decision means 5, the low-pass filter 6 suppresses the high-frequency components contained in the source sound signal.

Furthermore, the system comprises motion speed calculation means 7, another coefficient decision means 8, and a filter 9. The motion speed calculation means 7 calculates the speed and direction of a sound image that is moving, based on variations in time of the distance calculated by the distance calculation means 4. The coefficient decision means 8 determines the coefficients of the filter 9 according to the motion speed and direction calculated by the motion speed calculation means 7. The filter 9, configured with the coefficients determined by the coefficient decision means 8, suppresses either high-frequency components or low-frequency components contained in the source sound signal.

The above three-dimensional sound processing system will operate as follows. The enhancement means 1 emphasizes the difference of two impulse responses in the original sound field, which represents the acoustic characteristics of spatial sound paths from a sound source to the tympanic membranes of a listener's left and right ears. Here, the impulse responses of both spatial sound paths are measured in advance through an appropriate measurement procedure.

This difference enhancement allows the sound image to be positioned better in the front-to-rear (F-R) direction. The system performs such enhancement for each location of the sound source and, based on the two difference-enhanced impulse responses, determines a series of coefficient values to be used in the sound image positioning filter 3 for each location of the sound source. The determined coefficients will be stored in the memory means 2 separately for each sound source position. The memory means 2, therefore, contains a plurality of coefficient groups for different sound source positions.

According to a given sound image position, the sound image positioning filter 3 retrieves one of the coefficient groups out of the memory means 2 and configures itself with the retrieved coefficient values. This makes it possible for the sound image positioning filter 3 to add the acoustic characteristics of the original sound field to the source sound signal.

Separately from this, the sound image positioning filter 3 also subtracts, in advance, the acoustic characteristics of the reproduced sound field from the source sound signal, based on the inverse acoustic characteristics of the reproduced sound field.

In the way described above, according to the present invention, the enhancement means 1 enhances the difference of two impulse responses pertaining to two separate sound paths reaching the listener's ears in the original sound field, thereby yielding improved sound image positioning in the F-R direction in the reproduced sound field.

Further, the distance calculation means 4 calculates the distance between a sound image and listener in the reproduced sound field, and the coefficient decision means 5 determines the coefficient values of the low-pass filter 6 according to the distance calculated by the distance calculation means 4. The sound effect brought by this operation is as follows.

In general, sounds are attenuated while propagating in air, and the degree of this attenuation depends on the frequency of the sound. The higher the frequency is, the more the sound amplitude will be lost during the travel in air. This causes such a phenomenon that the listener will receive a muffled sound from a remote sound source, depending on the distance from the listener, because of the attenuation of high frequency components. To simulate this change in the frequency spectrum, the sound processing system is equipped with a low-pass filter 6, whose characteristics are programmed in such a way that it will vary the degree of treble suppression according to the distance between the sound image and the listener. The low-pass filter 6 with such a capability can be implemented as a first-order IIR filter, whose coefficients are determined so as to cause a deeper suppression of high-frequency components of the sound signal as the distance increases.

In the way described above, the three-dimensional sound processing system according to the present invention will control the distance perspective of a sound image with less data processing loads and memory consumption.

Furthermore, in the present invention, the motion speed calculation means 7 calculates the speed and direction of a moving sound image based on the temporal change of the sound image distance calculated by the calculation means 4. The coefficient decision means 8 determines the coefficient values of the filter 9, according to the calculated motion speed and direction. The sound effect caused by this operation is clarified as follows.

In general, the frequency spectrum of a sound will shift to a higher frequency range when the sound source is approaching the listener and shifts to a lower frequency range when the sound source is leaving the listener. To obtain a similar sound effect in the reproduced sound field, the sound processing system configures a filter 9 as a high-pass filter to suppress the lower frequency components when the sound image is approaching the listener, while reconfiguring the filter 9 as a low-pass filter to suppress the higher frequency components when the sound image is leaving the listener.

In addition to this dynamic mode switching of the filter 9, the present invention will further control the degree of suppression, depending on the motion speed of the sound image. The coefficient values of the filter 9 are modified so that the suppression will be enhanced as the motion speed becomes faster. The filter 9 with such capabilities can be implemented as a simple first-order IIR filter.

In the way described above, the present invention enables the motion of a sound image to be controlled with less data processing loads and memory consumption.

Referring next to FIGS. 2 to 6, the following description will present a specific configuration of the above-described first embodiment of the present invention. While the structural elements in FIG. 1 and those in FIGS. 2 to 6 have close relationships, their detailed correspondence will be separately described after the following discussion is finished.

Figure 2:
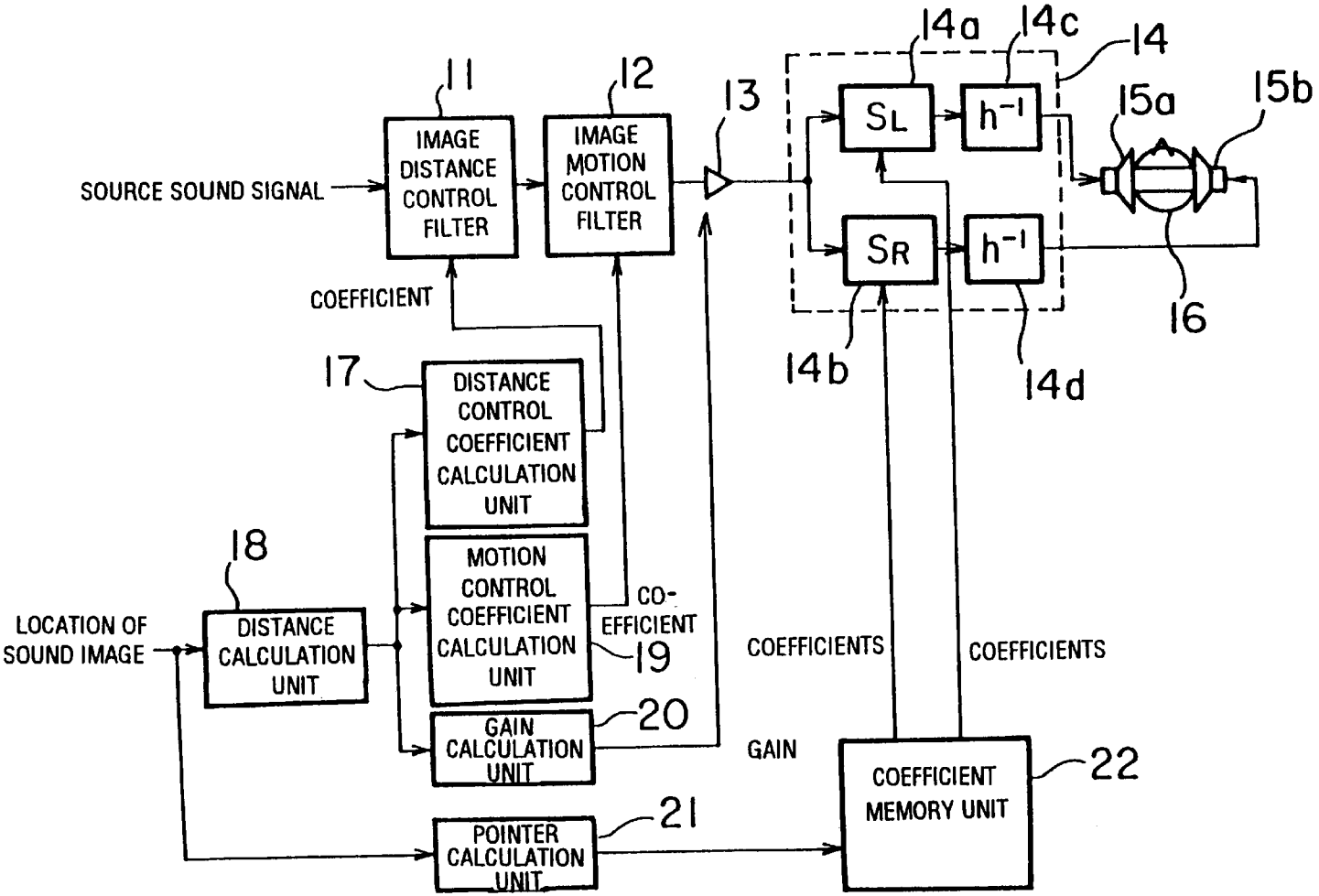
FIG. 2 is a total block diagram of a three-dimensional sound processing system according to a first embodiment of the present invention.

FIG. 2 is a total block diagram of a three-dimensional sound processing system according to the first embodiment of the present invention. The input sound signal, or a source sound signal, is processed while passing through an image distance control filter 11, an image motion control filter 12, a variable gain amplifier 13, and a sound image positioning filter 14. Two channel stereo signals are finally obtained to drive a pair of earphones 15*a* and 15*b*. From these earphones 15*a* and 15*b*, a listener 16 hears the recreated three-dimensional sound including complex acoustic information added by this sound processing system.

Figure 4:
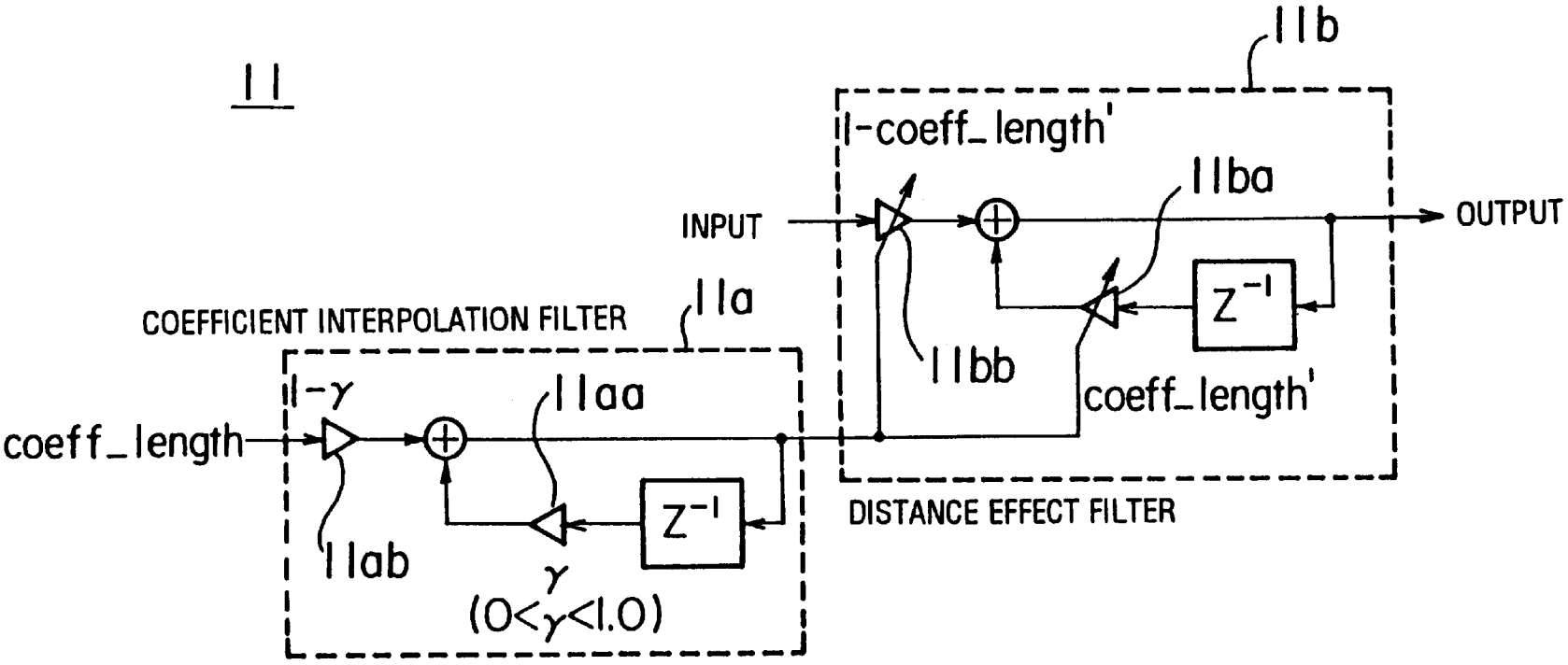
FIG. 4 is a diagram showing the internal structure of an image distance control filter.

Here, a distance control coefficient calculation unit 17 is connected to the image distance control filter 11 under the control of a distance calculation unit 18. The distance calculation unit 18 receives information on the location of a sound image and calculates the distance parameter "length" between the sound image and the listener 16. Based on the calculated distance parameter "length", the distance control coefficient calculation unit 17 calculates a coefficient "coeff_length" through a procedure described later, and sends it to the image distance control filter 11. The image distance control filter 11 has the internal structure as shown in FIG. 4 to serve as a low-pass filter for controlling the distance perspective of a sound image.

Figure 5:
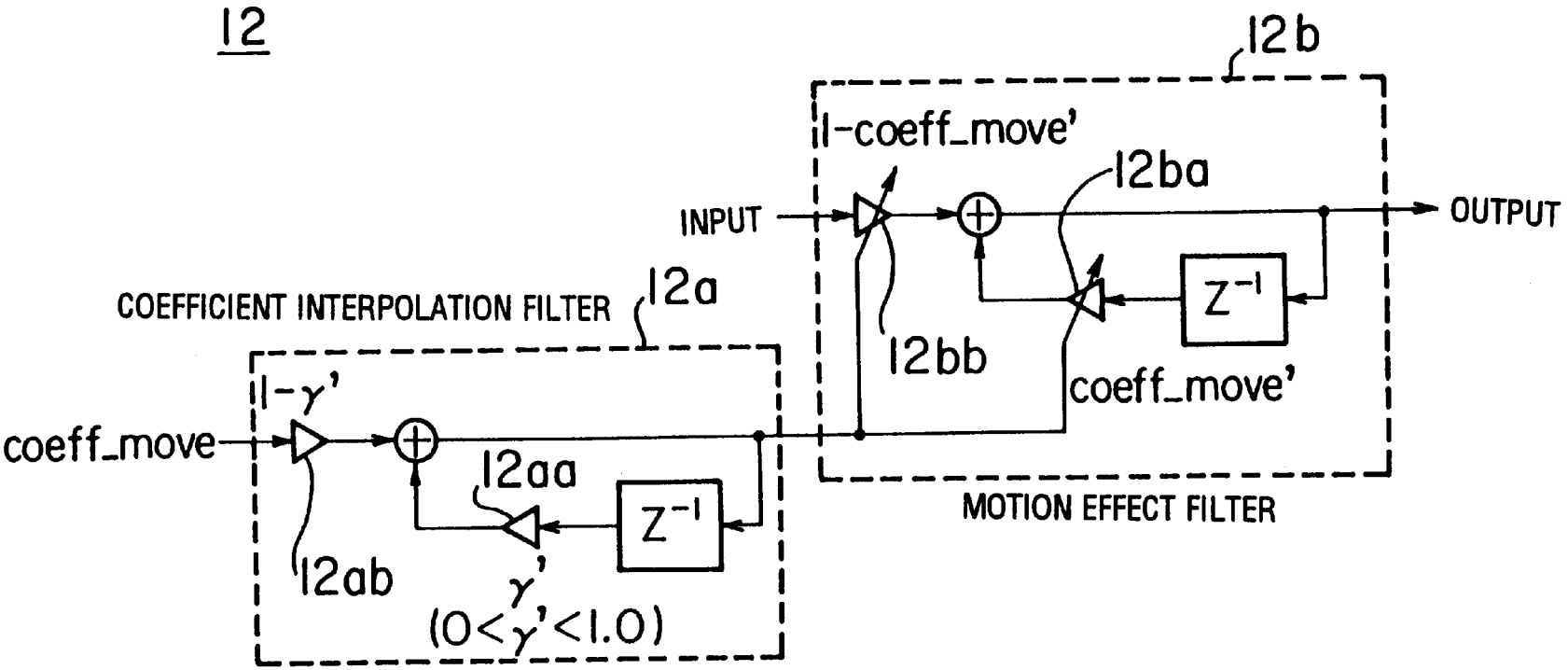
FIG. 5 is a diagram showing the internal structure of an image motion control filter.

A motion control coefficient calculation unit 19, coupled to the distance calculation unit 18, provides the image motion control filter 12 with its coefficient values. This motion control coefficient calculation unit 19 calculates a coefficient "coeff_move" through a procedure described later, based on temporal variations of the distance parameter "length" calculated by the distance calculation unit 18. The calculated coefficient "coeff_move" is sent to the image motion control filter 12. The image motion control filter 12 with the internal structure as shown in FIG. 5 serves as a low-pass or high-pass filter to implement the motion of a sound image into the source sound signal.

The variable gain amplifier 13 is controlled by a gain calculation unit 20 coupled to the distance calculation unit 18. This gain calculation unit 20 calculates an amplification gain "g" according to the following equation (1), based on the distance parameter "length" calculated by the distance calculation unit 18, and provides it to the variable gain amplifier 13.

$$g=a/(1+b\times length) \tag{1}$$

where a and b are positive-valued constants.

Equation (1) shows that the amplification gain g is set to a smaller value as the distance parameter "length" becomes larger. With such gain settings, the variable gain amplifier 13 amplifies the source sound signal, working together with the aforementioned image distance control filter 11 to perform a distance perspective control for the recreated sound image.

The sound image positioning filter 14 comprises four FIR filters 14*a*, 14*b*, 14*c*, and 14*d*. The filters ($S_L$, $S_R$) 14*a* and 14*b* add the acoustic characteristics of the original sound field, while the filters ($h^{-1}$, $h^{-1}$) 14*c* and 14*d* subtract the acoustic characteristics concerning the earphones 15*a* and 15*b* in the reproduced sound field. The coefficients of the filter 14*c* and 14*d* have fixed values that are determined from an inverse impulse response representing inverse characteristics of the impulse response of the reproduced sound field, which has been measured in advance.

On the other hand, the coefficients of the filter 14*a* and 14*b* are not fixed but dynamically selected from among a plurality of coefficient groups stored in the coefficient memory unit 22, according to the location of a sound image. That is, the coefficient values of the filters 14*a* and 14*b* will vary, depending on the sound image position. For this purpose, the coefficient memory unit 22 stores a plurality of groups of coefficient values that have been obtained in advance through an appropriate procedure to be described later. The values for each sound source location are packaged in a contiguous address space. This allows a pointer calculation unit 21 to locate and retrieve a group of coefficient values corresponding to each location of the sound source by simply designating the starting address of the contiguous address space.

Figure 3:
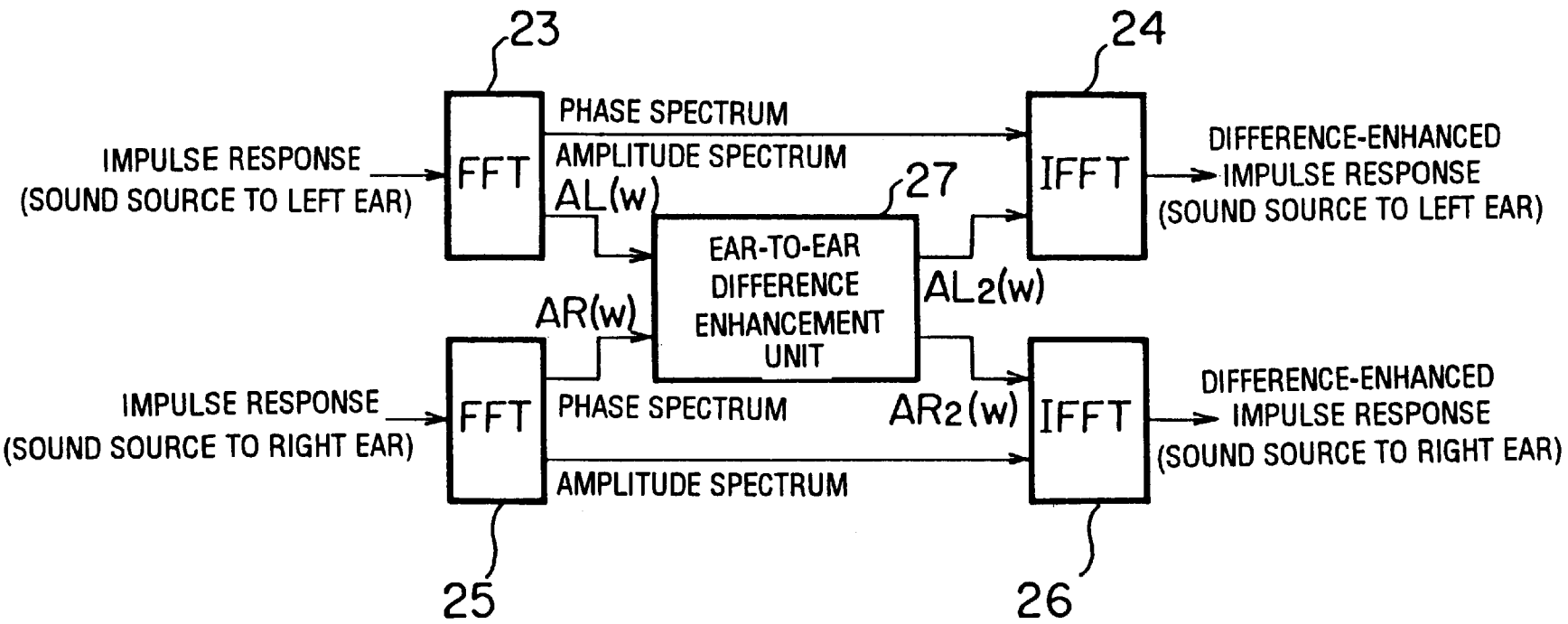
FIG. 3 is a diagram showing a filter coefficient enhancement unit that creates a plurality of coefficient groups to be stored in coefficient memory means.

FIG. 3 shows a filter coefficient enhancement unit that creates a plurality of coefficient values to be stored in the coefficient memory unit 22. The filter coefficient enhancement unit comprises a fast Fourier transform unit (FFT) 23 and inverse FFT unit (IFFT) 24 for the left ear, an FFT unit 25 and inverse FFT unit 26 for the right ear, and an ear-to-ear difference enhancement unit 27.

For every possible sound source location in the original sound field, the impulse responses of spatial sound paths from the sound source to listener's left and right tympanic membranes are measured in advance. Among those impulse responses obtained in the measurement, impulse responses of the left ear are subjected to the FFT unit 23 to create their respective phase spectrums and amplitude spectrums that show its characteristics in the frequency domain. Likewise, impulse responses of the right ear are subjected to the FFT unit 25 to create their respective phase spectrums and amplitude spectrums.

The ear-to-ear difference enhancement unit 27 receives from the FFT units 23 and 25 a pair of amplitude spectrums of both ears for each sound source location. The amplitude spectrums of the left and right-ear responses are represented by functions AL(ω) and AR(ω), respectively, where ω is an angular frequency ranging $0 \leqq \omega \leqq \pi$ normalized with the system's sampling frequency. The ear-to-ear difference enhancement unit 27 calculates a first amplitude spectrum $AL_1(\omega)$ according to the following equation (2). This Equation (2) enhances the left-ear amplitude spectrum AL(ω) by the difference between the two amplitude spectrums AL(ω) and AR(ω).

$$log[AL_1(\omega)]=log[AL(\omega)]+\alpha\{log[AL(\omega)]-log[AR(\omega)]\} \quad (2)$$

where α is a positive-valued constant. Note here that the difference enhancement calculation is done in the logarithmic scale, where multiplication and division of two variables are expressed as addition and subtraction of their logarithms.

This difference-enhanced first amplitude spectrum log $[AL_1(\omega)]$ is then converted to a linear-scaled value according to the following equation (3).

$$AL_1(\omega)=exp(log[AL_1(\omega)]) \quad (3)$$

Furthermore, some level adjustment in the frequency domain is applied to the first amplitude spectrum $AL_1(\omega)$ according to the following equation (4), thereby obtaining a second amplitude spectrum $AL_2$ (ω). The obtained second amplitude spectrum $AL_2(\omega)$ is then supplied to the inverse FFT unit 24. As an alternative configuration, this level adjustment can also be achieved in the time domain after the sound signal is processed by the inverse FFT unit 24.

$$AL_2(\omega)=AL_1(\omega)\times(MAX\,[AL(\omega)]/MAX[AL_1(\omega)]) \quad (4)$$

where the function MAX[AL(ω)] represents the maximum value of the original amplitude spectrum AL(ω) within the range of $0 \leqq \omega \leqq \pi$, and the function $MAX[AL_1(\omega)]$ shows the maximum value of the difference-enhanced first amplitude spectrum $AL_1(\omega)$ within the range of $0 \leqq \omega \leqq \pi$.

The amplitude spectrum AR(ω) input to the ear-to-ear difference enhancement unit 27 is output to the inverse FFT unit 26, according to the following equation (5), in which the output signal is referred to as a second amplitude spectrum $AR_2(\omega)$.

$$AR_2(\omega)=AR(\omega) \quad (5)$$

The inverse FFT unit 24 performs an inverse fast Fourier transform for the phase spectrum sent from the FFT unit 23 and the second amplitude spectrum $AL_2(\omega)$ sent from the ear-to-ear difference enhancement unit 27, thereby obtaining a left-channel impulse response in the time domain. Similarly, the inverse FFT unit 26 performs an inverse fast Fourier transform for the phase spectrum sent from the FFT unit 25 and the second amplitude spectrum $AR_2(\omega)$ sent from the ear-to-ear difference enhancement unit 27, thereby obtaining a right-channel impulse response in the time domain.

The above-described difference enhancement process is executed for each location of the sound source, and the difference-enhanced impulse responses obtained through the process are stored into the coefficient memory unit 22 separately for each sound source location.

Figure 7:
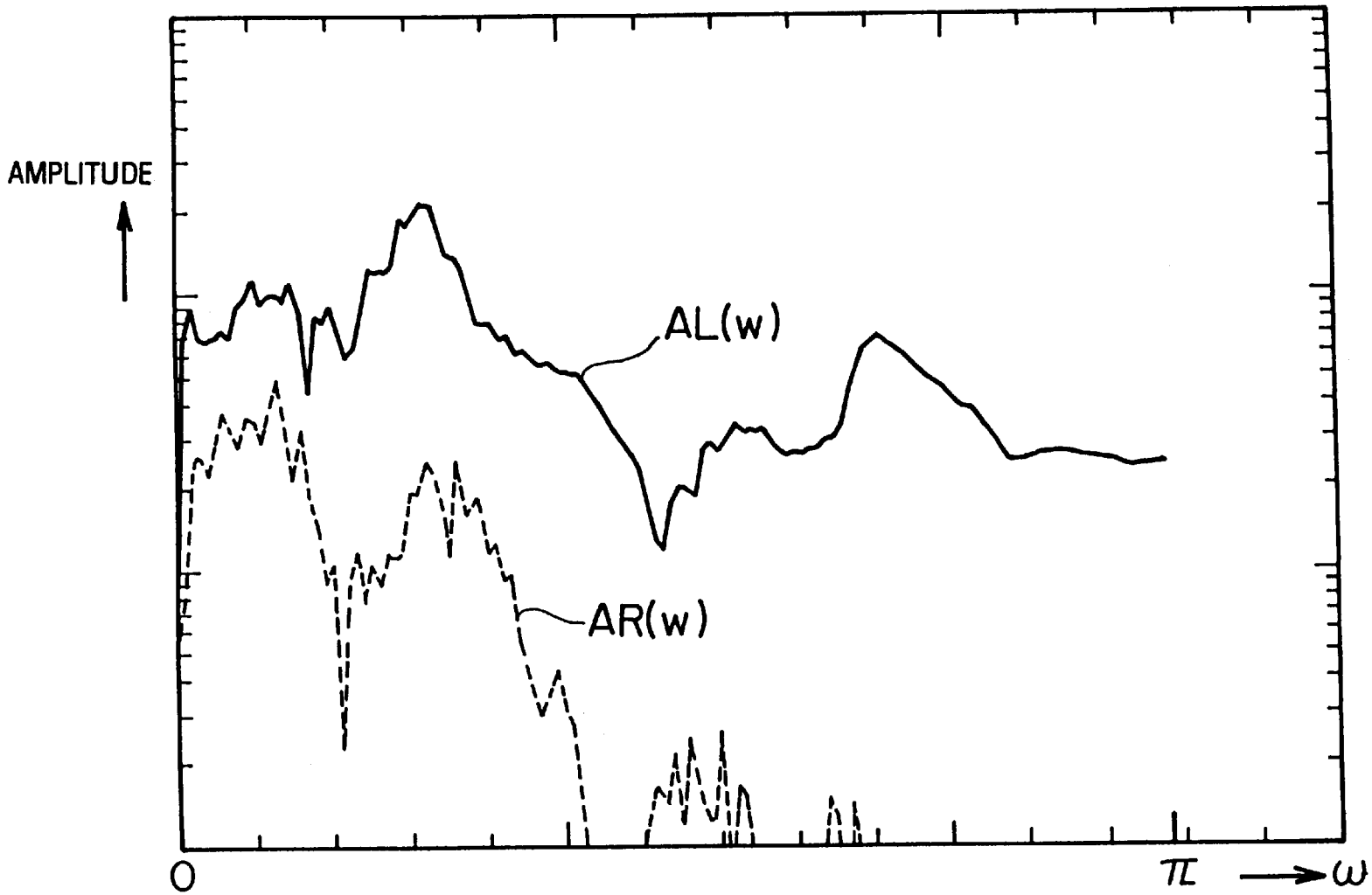
FIG. 7 is a diagram showing amplitude spectrums $AL(\omega)$ and $AR(\omega)$ in the case that a sound source is located in the front left direction with respect to a listener, forming an azimuth angle of 60 degrees.
Figure 8:
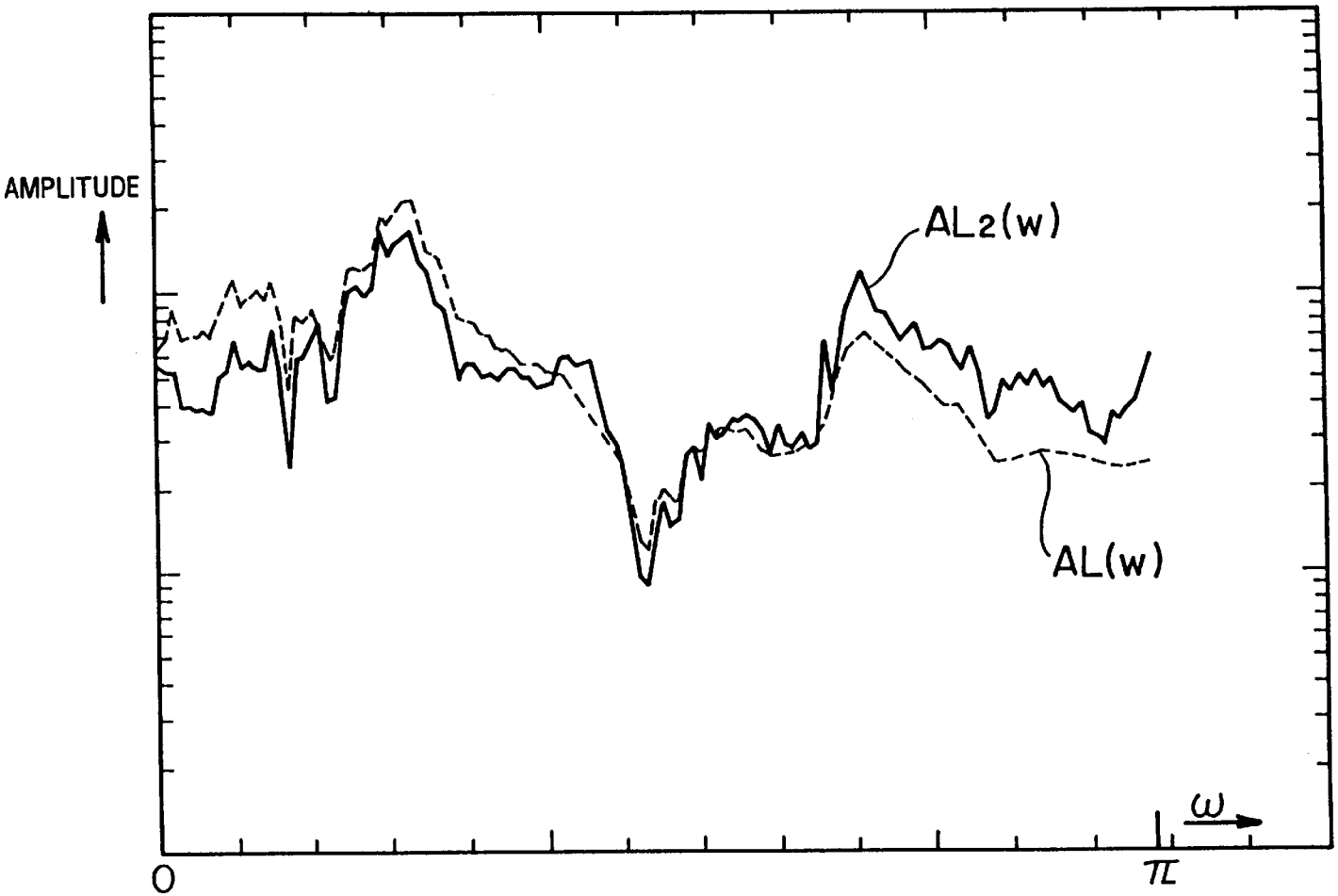
FIG. 8 is a diagram showing a difference-enhanced second amplitude spectrum $AL_2(\omega)$.

Referring next to FIGS. 7 and 8, the following description will explain a different aspect of the above-described difference enhancement performed by the ear-to-ear difference enhancement unit 27.

FIG. 7 shows an example of the amplitude spectrums AL(ω) and AR(ω), which are obtained in such a sound field where a sound source is located in the front left direction at the 60-degree azimuth angle. When these amplitude spectrums AL(ω) and AR(ω) are applied to the above-described ear-to-ear difference enhancement unit 27, the resultant second amplitude spectrum $AL_2(\omega)$ will be as indicated by the solid line in FIG. 8. For comparison, FIG. 8 also shows the original amplitude spectrums AL(ω) with a broken line.

As seen in FIG. 8, the difference-enhanced amplitude spectrum $AL_2(\omega)$ is boosted particularly at a high angular frequency range when compared with the amplitude spectrum AL(ω) before enhancement. Such an enhancement meets a characteristic of the human hearing system, in which high frequency components play an important role in locating a sound source in the F-R direction. As a result of the ear-to-ear difference enhancement, the sound processing system according to the present invention provides an improved positioning of a recreated sound image.

In the above-described first embodiment, the ear-to-ear difference enhancement unit 27 is configured to emphasize the left-ear amplitude spectrum AL(ω) by the difference between the amplitude spectrums AL(ω) and AR(ω), while maintaining the right-ear amplitude spectrum AR(ω) as is. As an alternate arrangement, the ear-to-ear difference enhancement unit 27 can also be configured so that it will enhance the right-ear amplitude spectrum AR(ω) by the difference between the two amplitude spectrums AL(ω) and AR(ω), while keeping the left-ear amplitude spectrum AL(ω) as is.

In another alternative arrangement, the ear-to-ear difference enhancement unit 27 can be configured so that it will calculate an average response curve between the left and right amplitude spectrums AL(ω) and AR(ω), and enhance the both amplitude spectrums AL(ω) and AR(ω) with respect to the average amplitude response.

Figure 9:
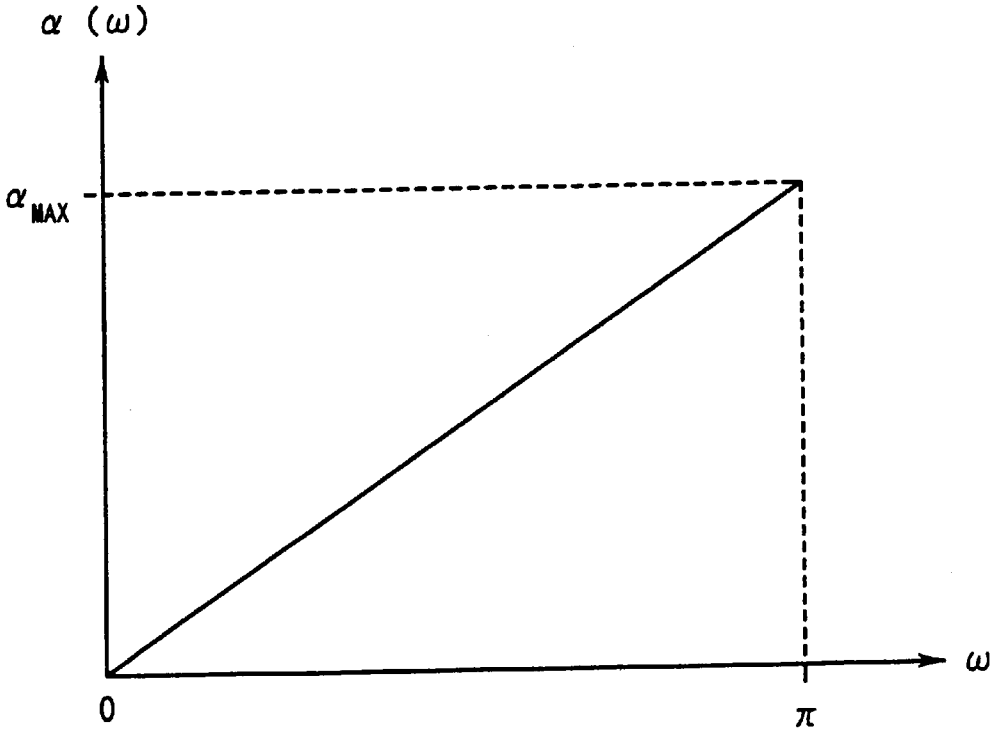
FIG. 9 is a diagram showing a variable $\alpha(\omega)$ that varies with angular frequency $\omega$.
Figure 10:
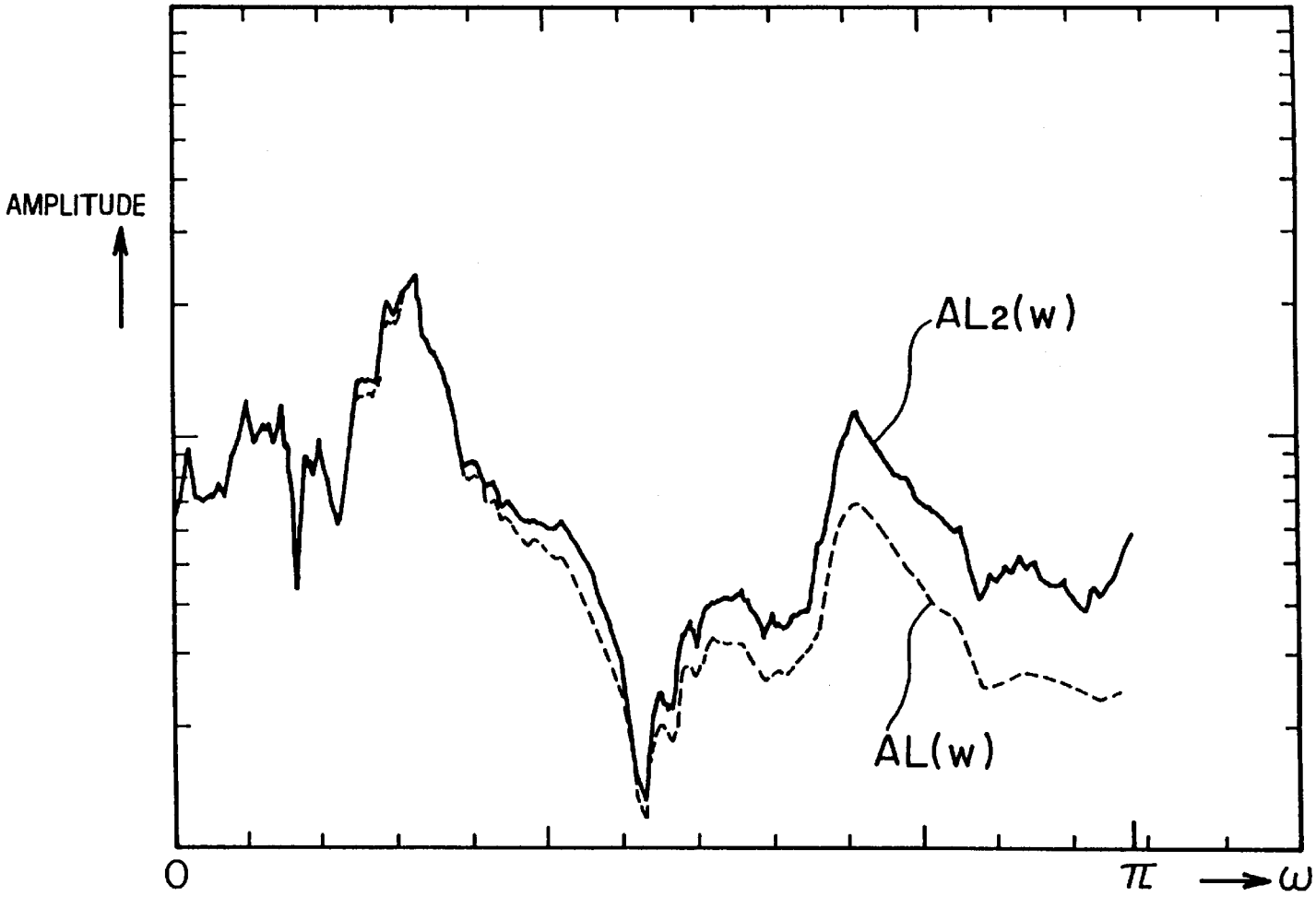
FIG. 10 is a diagram showing an difference-enhanced second amplitude spectrum $AL_2(\omega)$ that can be obtained by using the variable $\alpha(\omega)$.

As a further alternate arrangement, the ear-to-ear difference enhancement unit 27 can be configured so that it will enhance the left-ear amplitude spectrum AL(ω) by the difference between the two amplitude spectrums AL(ω) and AR(ω) using the same equations (2)–(5) except that the multiplier α in equation (2) is not constant but controlled as a function of the angular frequency ω namely, α(ω). See FIG. 9, for example, where the value of this function α(ω) is raised as the angular frequency ω increases. By substituting such a value α(ω) for the constant α, equation (2) will yield a difference-enhanced second amplitude spectrum $AL_2$ (ω) as shown in FIG. 10.

Figure 6:
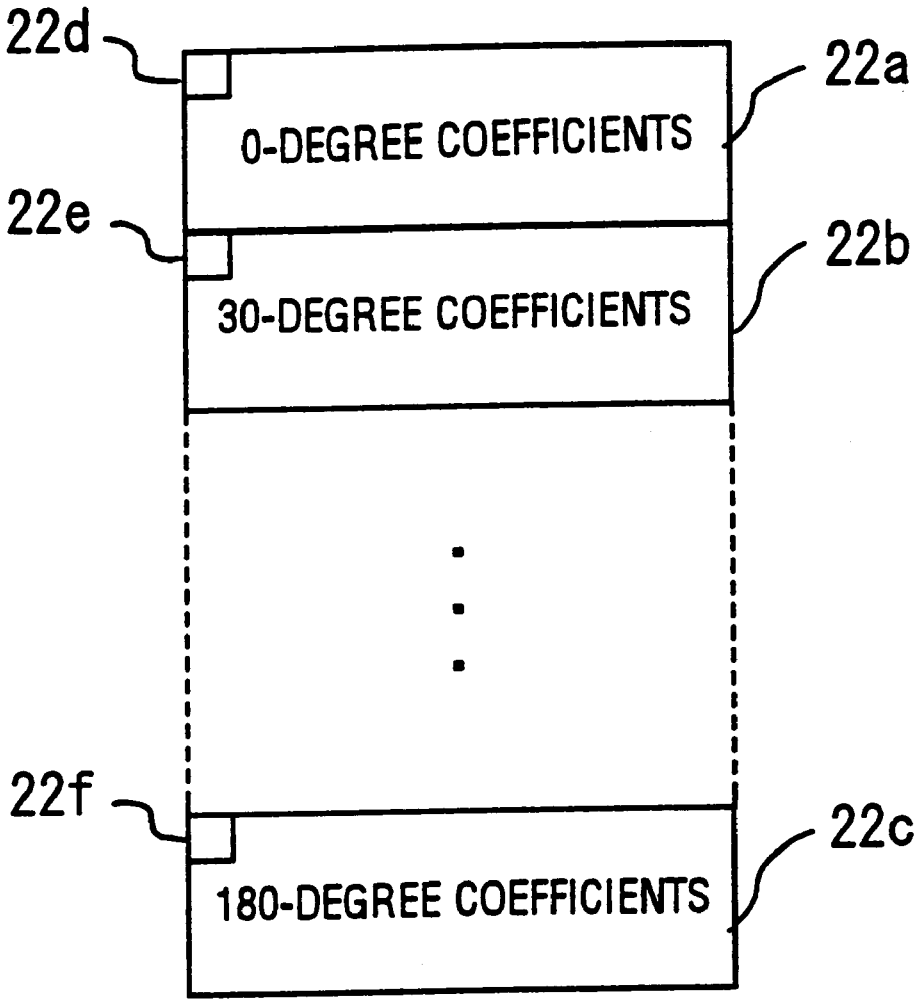
FIG. 6 is a diagram showing memory allocation in coefficient memory means.

FIG. 6 shows memory allocation in the coefficient memory unit 22. Assume that the impulse responses are measured at every 30 degrees azimuth angle of the sound source relative to the listener's position, where 0 degree azimuth is directly in front of the listener, and 180 degrees azimuth is directly in the rear of the listener. The coefficient memory unit 22 stores the measured data for 0-degree, 30-degree, . . . 180-degree azimuth angles in their dedicated storage areas 22*a*, 22*b*, . . . 22*c*, respectively. Each storage area has a plurality of memory cells with contiguous addresses starting from their respective top addresses 22*d*, 22*e*, . . . 22*f*, which are selectable with an address pointer. When one of those top addresses is specified by the address pointer, a set of coefficients saved in the corresponding storage area are retrieved and sent to the filters 14*a* and 14*b* shown in FIG. 2. In the way described above, the sound image positioning filter 14 can achieve excellent positioning of the sound image.

Next, the following description will explain a distance control process executed by the distance control coefficient calculation unit 17.

The distance control coefficient calculation unit 17 calculates the coefficient "coeff_length" according to the following equation (6), using a distance parameter "length" sent from the distance calculation unit 18.

$$coeff_length=\alpha_1\times[1-(1+\beta_1\times length)^1] \quad (6)$$

where $\alpha_1$ and $\beta_1$ are constants ranging $0<\alpha_1<1$ and $0<\beta_1$, respectively.

This equation (6) means that the coefficient "coeff_length" converges to a constant value $\alpha_1$ as the distance parameter "length" increases, and it also converges to zero as the distance parameter "length" descreases. The coefficient "coeff_length" having such a nature is sent to the image distance control filter 11.

FIG. 4 shows the internal structure of the image distance control filter 11. The image distance control filter 11 comprises a coefficient interpolation filter 11*a* and a distance effect filter 11*b*. Those two filters 11*a* and 11*b* are both first-order IIR low-pass filters. The coefficient interpolation filter 11*a* avoids abrupt variation of the coefficient "coeff_length" and provides a smooth change of the coefficient.

When the three-dimensional sound processing system is coupled to, for example, a computer graphics application running on a personal computer, the sound image location cannot be updated frequently enough because of the large data processing load of the computer graphics imposes on the personal computer. As a result, the coefficient "coeff_length" provided by the distance control coefficient calculation unit 17 loses time-continuity and exhibits a sudden change in its magnitude. The coefficient interpolation filter 11*a*, having a low-pass response, receives a time-discontinuous coefficient "coeff_length" and outputs the smoothed values.

The coefficient interpolation filter 11*a* comprises two multipliers 11aa and 11ab and other elements to form a first-order IIR low-pass filter. The multiplier 11aa multiplies the output signal of a delay unit ($Z^{-1}$) by a constant factor $\gamma(0<\gamma<1)$ which determines how deeply the high-frequency components will be suppressed. The multiplier 11ab multiplies a constant factor (1—$\gamma$) so that the coefficient interpolation filter 11*a* will maintain a unity gain in the DC range. The interpolated output from the coefficient interpolation filter 11*a* is named here as the coefficient "coeff_length*," which is supplied to the distance effect filter 11*b*.

The distance effect filter 11*b* is composed of two multipliers 11ba and 11bb and other elements to form a first-order IIR low-pass filter as in the coefficient interpolation filter 11*a*. The multiplier 11ba multiplies the output signal of a delay unit ($Z^{-1}$) by the smoothed coefficient "coeff_length*" received from the coefficient interpolation filter 11*a*, thereby suppressing the high-frequency components of the source sound signal input to the image distance control filter 11. The multiplier 11bb multiplies the input signal by the value (1-coeff_length*) so that the distance effect filter 11*b* will maintain a unity gain in the DC range.

The degree of this high-frequency suppression is determined by the value of the smoothed coefficient "coeff_length*." That is, as the distance parameter "length" becomes larger, the coefficient "coeff_length" converges to the value a $\alpha_1$ as clarified above, and this will result in an increased suppression of high frequency components of the source sound signal. In turn, a smaller distance parameter "length" will cause the coefficient "coeff_length" to be decreased, thereby reducing the suppression of high-frequency components contained in the source sound signal.

As previously mentioned, sounds having higher frequencies are more likely to be attenuated while propagating in air, and thus, the listener will receive a muffled sound from a remote sound source because of the attenuation of high-frequency components. The distance, effect filter 11*b* just simulates this nature of the sound.

Since it is possible to fully realize the image distance control filter 11 by using a simple first-order IIR filter scheme, the present invention controls the distance perspective of a sound image with a smaller amount of data processing and less memory consumption.

Next, the following description will explain a process performed by the motion control coefficient calculation unit 19.

The motion control coefficient calculation unit 19 receives a distance parameter "length" from the distance calculation unit 18. The distance calculation unit 18 first calculates the difference between the current distance parameter "length" and the previous distance parameter "length_old" to obtain the motion speed in the sound image. The distance calculation unit 18 then computes a coefficient "coeff_move" based on the following equations (7*a*) and (7*b*), considering the polarity (positive/negative) of the motion speed.

$$If\ (length-length_old)>0,\ coeff_move=\alpha_2\times[1-(1+\beta_2\times[length-length_old])^{-1}] \quad (7a)$$

$$If\ (length-length_old)<0 coeff_move=-\alpha_2\times[1-(1+\beta_2\times[length_old-length])^{-1}] \quad (7b)$$

where constants $\alpha_2$ and $\beta_2$ are constants ranging $0<\alpha_2<1$ and $0<\beta_2$ respectively.

Equation (7*a*) indicates that, when the motion speed (length-length_old) is positive (i.e., when the sound image is leaving the listener), the coefficient "coeff_move" converges to a constant value $\alpha_2$ as the absolute value of the motion speed (|length-length_oldl) becomes larger. Similarly, equation (7*b*) shows that, when the motion speed is negative (i.e., when the sound image is approaching the listener), the coefficient "coeff_move" converges to a constant value ($-\alpha_2$), as the absolute motion speed becomes larger. Further, equations (7*a*) and (7*b*) both indicate that the coefficient "coeff_move" will converge to zero as the absolute motion speed becomes smaller. The motion control coefficient calculation unit 19 creates the coefficient "coeff_move" having such a nature and sends it to the image motion control filter 12.

FIG. 5 is a diagram showing the internal structure of the image motion control filter 12. The image motion control filter 12 comprises a coefficient interpolation filter 12*a* and a motion effect filter 12*b*. The coefficient interpolation filter 12*a* is a first-order IIR low-pass filter. The motion effect filter 12*b* is a first-order IIR filter which works as a low-pass filter when a positive-valued coefficient is given, and serves as a high-pass filter when a negative-valued coefficient is applied.

The coefficient interpolation filter 12*a* is a filter that converts a steep change in the coefficient "coeff_move" into a moderate variation similar to the coefficient interpolation filter 11*a* explained in FIG. 4, some time-discontinuous changes may happen to the value of the coefficient "coeff_move" supplied from the motion control coefficient calculation unit 19. The coefficient interpolation filter 12*a* accepts such a discontinuous coefficient "coeff_move" and removes high-frequency components with its low-pass characteristics, thereby outputting a smoothed coefficient "coeff_move*" to the motion effect filter 12*b*.

The coefficient interpolation filter 12*a* contains two multipliers 12aa and 12ab. The multiplication coefficient $\gamma^*$ ($0<\gamma^*<1$) applied to the multiplier 12aa determines the low-pass characteristics of this filter, and the multiplier 12ab equalizes the overall gain of the filter to maintain a unity DC gain.

The motion effect filter 12*b* is also an IIR filter containing two multipliers 12ba and 12bb, and other elements. The multiplier 12ba multiplies the internal feedback signal by the smoothed coefficient "coeff_move*" received from the coefficient interpolation filter 12*a,* thereby suppressing the high-frequency or low-frequency components of the original sound input signal according to the polarity of the coefficient value. The multiplier 12bb multiplies the value (1-coeff_move*) so that the motion effect filter 12*b* will maintain a unity gain in DC range.

As previously explained, when the motion speed (length-length_old) is positive (i.e., when the sound image is leaving the listener), the coefficient "coeff_move" converges to a constant value $\alpha_2$ as the absolute value of the motion speed (|length-length_old|) becomes larger. This will result in greater suppression of high-frequency components. When, in turn, the motion speed is negative (i.e., when the sound image is approaching the listener), the coefficient "coeff_move" converges to a negative constant value ($-\alpha_2$), as the absolute value of the motion speed becomes larger. This will result in greater suppression of low-frequency components by the motion effect filter 12*b*. Further, as the absolute value of the motion speed becomes smaller, the coefficient "coeff_move" will converge to zero regardless of whether the motion speed value is positive or negative, thus reducing the degree of high-frequency or low-frequency suppression.

In summary, the motion effect filter 12*b* suppresses the high-frequency components of the sound signal when the sound image goes away, and enhances this suppression for higher motion speeds. When the sound image is approaching the listener, the motion effect filter 12*b* suppresses the low-frequency components, and enhances this suppression as the motion speed is increased.

Generally, the frequency spectrum of a sound signal shifts to a lower frequency range when the sound source is leaving the listener, while shifting to a higher frequency range when the sound source is approaching the listener. By performing the above-described control, the motion effect filter 12*b* simulates this nature of approaching or leaving sounds.

Since it is possible to fully realize the image motion control filter 12 by using simple first-order IIR filters as illustrated in FIG. 5, the present invention controls the motion of sound images with a smaller amount of data processing and less memory consumption.

The constituents of the above-described first embodiment are related to the structural elements shown in FIG. 1 as follows. The enhancement means 1 shown in FIG. 1 corresponds to the filter coefficient enhancement unit shown in FIG. 3. The memory means 2 in FIG. 1 corresponds to the coefficient memory unit 22 in FIG. 2, and similarly, the sound image positioning filter 3 to the sound image positioning filter 14, the distance calculation means 4 to the distance calculation unit 18, the coefficient decision means 5 to the distance control coefficient calculation unit 17, the low-pass filter 6 to the image distance control filter 11, the motion speed calculation means 7 to the motion control coefficient calculation unit 19, the coefficient decision means 8 to the motion control coefficient calculation unit 19, and the filter 9 to the image motion control filter 12.

Figure 11:
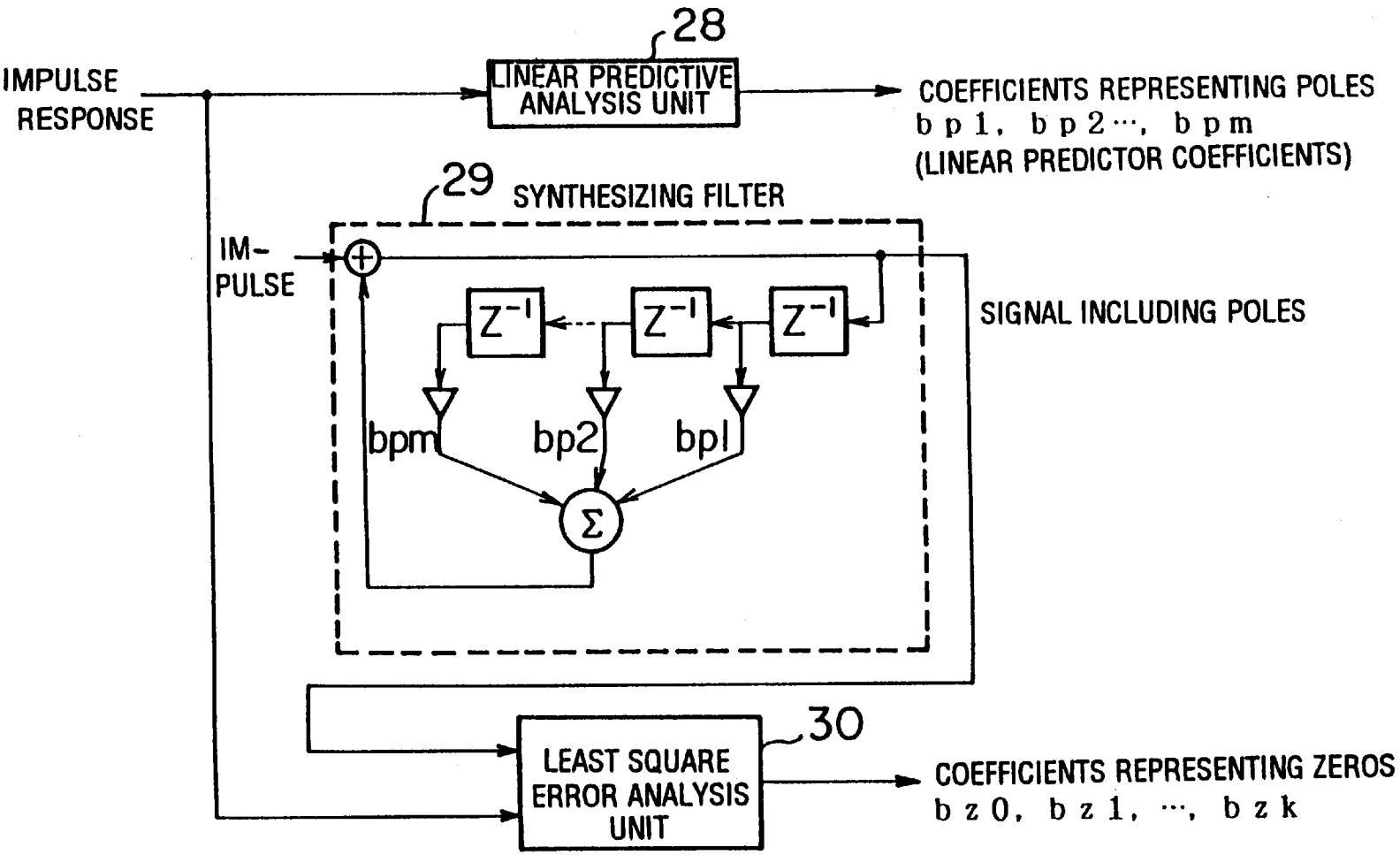
FIG. 11 is a diagram showing a filter coefficient calculation unit in a second embodiment of the present invention.
Figure 12:
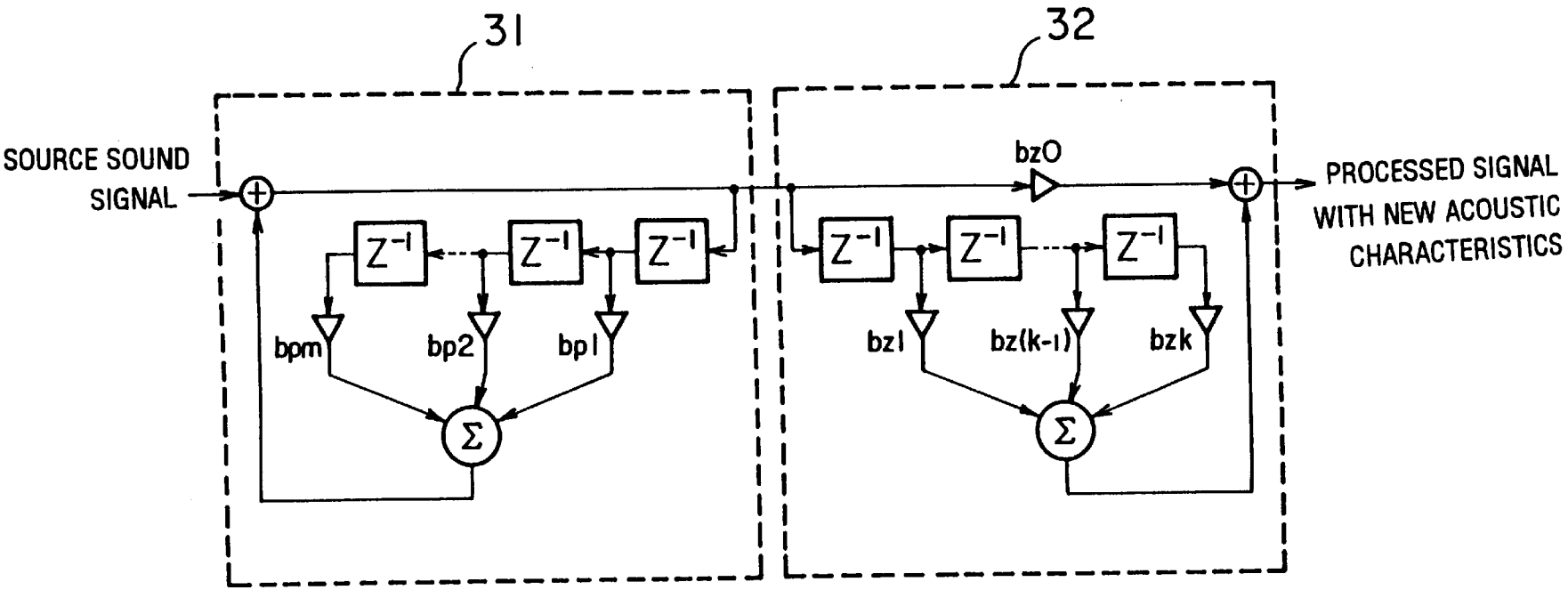
FIG. 12 is a diagram showing the internal structure of a filter in the second embodiment, which is used to add the acoustic characteristics of the original sound field.

Referring next to FIGS. 11 and 12, the following description will explain a second embodiment of the present invention. Since the structure of the second embodiment is basically the same as that of the first embodiment, the following description will focus on distinct points of the second embodiment.

In the second embodiment, the system employs a filter coefficient calculation unit coupled to the filter coefficient enhancement unit explained in the first embodiment. The second embodiment also differs from the first embodiment in the internal structure of the filters 14*a* and 14*b*.

FIG. 11 is a diagram showing the filter coefficient calculation unit proposed in the second embodiment. This filter coefficient calculation unit is a device designed to process each of the two impulse responses produced by the filter coefficient enhancement unit shown in FIG. 3. In FIG. 11, the filter coefficient calculation unit receives one of the two impulse responses pertaining to the listener's left and right ears, which are measured in advance in the original sound field. The received impulse response is delivered to a linear predictive analysis unit 28 and a least square error analysis unit 30. The linear predictive analysis unit 28 calculates the autocorrelation of the entered impulse response to yield a series of linear predictor coefficients bp1, bp2, . . . bpm. The Levinson-Durbin algorithm, for example, can be used in this calculation of linear predictor coefficients. The linear predictor coefficients bp1, bp2, . . . bpm obtained through this process will represent the poles, or peaks, involved in the amplitude spectrum as part of the entered impulse response.

Linear predictor coefficients bp1, bp2, . . . bpm calculated by the linear predictive analysis unit 28 are then set to an IIR-type synthesizing filter 29 prepared for recreation of some intended acoustic characteristics. When an impulse is applied, the synthesizing filter 29 will produce a specific impulse response "x" where the added poles take effect. This impulse response "x" is supplied to a least square error analysis unit 30, along with the impulse response "a" input to the filter coefficient calculation unit.

The least square error analysis unit 30 is a device designed to calculate a series of FIR filter coefficients bz0, bz1 . . . bzk that represent zeros, or dips, in the amplitude spectrum as part of the impulse response entered to the filter coefficient calculation unit of FIG. 11.

The following equation (8) shows the relationship between the impulse response "a" represented as a vector $[a0, a1, \ldots aq]^T$ ($q \geqq 1$) and the filter coefficients represented as a vector $[bz0, bz1, \ldots bzk]^T$ where superscript T indicates a transpose.

$$\begin{bmatrix} x0 & 0 & \ldots & 0 \\ x1 & x0 & \ldots & 0 \\ \vdots & \vdots & & \vdots \\ xk & xk-1 & & x0 \\ \vdots & \vdots & & \vdots \\ xq & xq-1 & \ldots & xq-k \end{bmatrix} \begin{bmatrix} bz0 \\ bz1 \\ \vdots \\ \vdots \\ \vdots \\ bzk \end{bmatrix} = \begin{bmatrix} a0 \\ a1 \\ \vdots \\ ak \\ \vdots \\ aq \end{bmatrix} \tag{8}$$

where x0, x1, . . . xq are elements representing the impulse response "x".

By naming the left part matrix as X, this equation (8) can be simply rewritten as $$Xb=a \tag{9}$$

where a and b are vectors representing the filter coefficients and the impulse response, respectively. Multiplying both parts by a transposed matrix $X^T$ will lead to $$X^TXb=X^Ta \tag{10}$$

Then equation (10) yields $$b=(X^TX)^{-1}X^Ta \tag{11}$$

Based on this equation (11), the least square error analysis unit 30 calculates the filter coefficients bz0, bz1, . . . bzk. Here, the least square error analysis unit 30 can be configured such that it will solve the coefficient bz0, bz1, . . . bzk by using steepest descent techniques.

The filter coefficient calculation unit of FIG. 11 also executes the same process for the remaining one of the two impulse responses provided from the filter coefficient enhancement unit of FIG. 3, thus producing the linear predictor coefficients bp1, bp2, . . . bpm representing poles and the filter coefficients bz0, bz1, . . . bzk representing zeros.

FIG. 12 shows the internal structure of filters implemented in the second embodiment as alternatives to the filters 14*a* and 14*b* in the first embodiment. Since the two filters for L and R channels have identical structures, FIG. 12 shows the details of only one channel.

The filter actually contains two filters connected in series an IIR filter 31 and FIR filter 32. The first filter 31 has linear predictor coefficients bp1, bp2, . . . bpm provided by the linear predictive analysis unit 28, while the second filter 32 has coefficients bz0, bz1, . . . bzk supplied by the least square error analysis unit 30.

This filter configuration will dramatically reduce the number of taps, when compared with the filters 14*a* and 14*b* in the first embodiment, which requires several hundreds to several thousands taps to reproduce the original sound field characteristics. Such a configuration in the second embodiment is a combination of the first embodiment of the present invention and the sound processing technique which is proposed in the Japanese Patent Application No. Hei 7-231705 by the applicant of the present invention.

Figure 13:
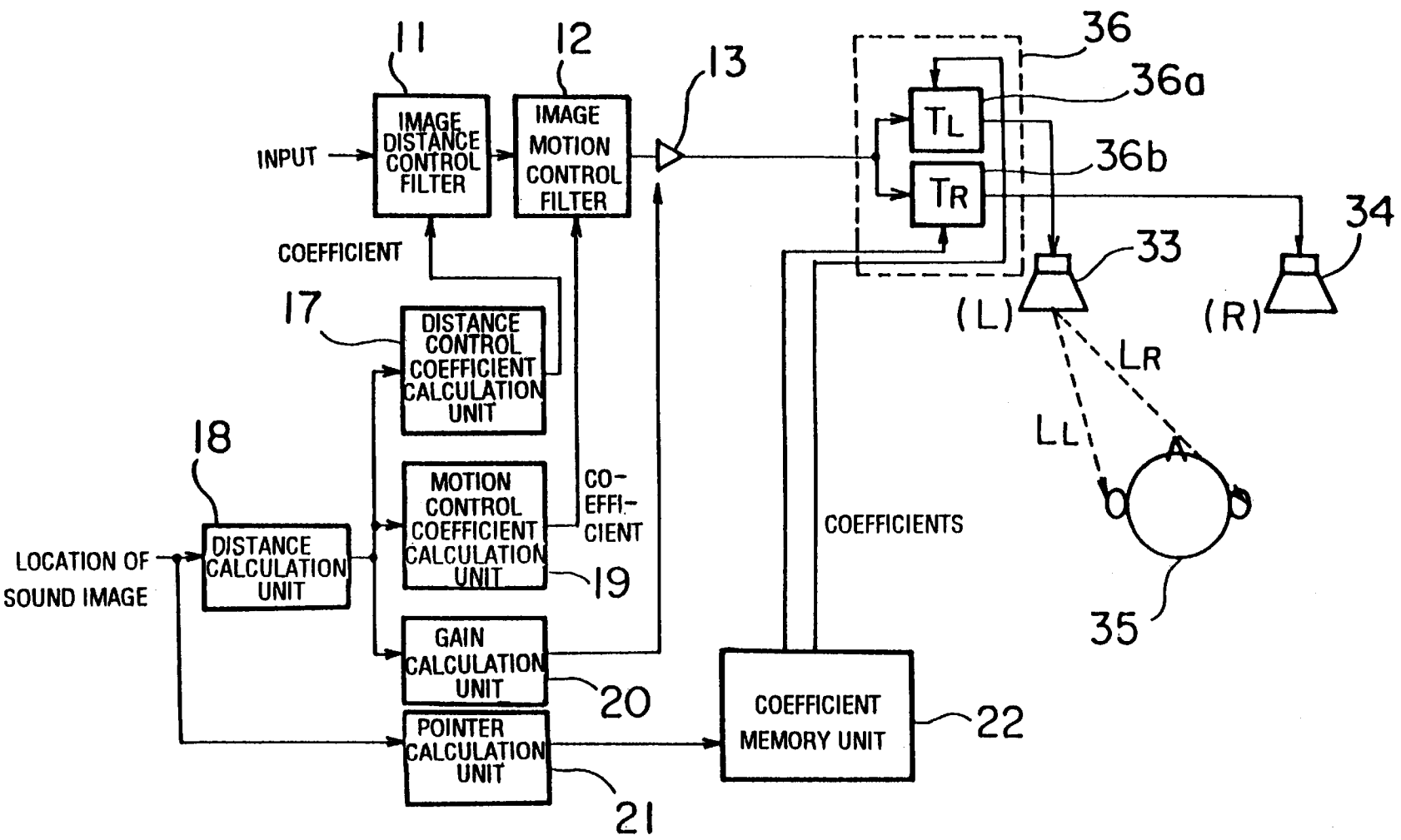
FIG. 13 is a total block diagram of a three-dimensional sound processing system according to a third embodiment of the present invention.
Figure 14:
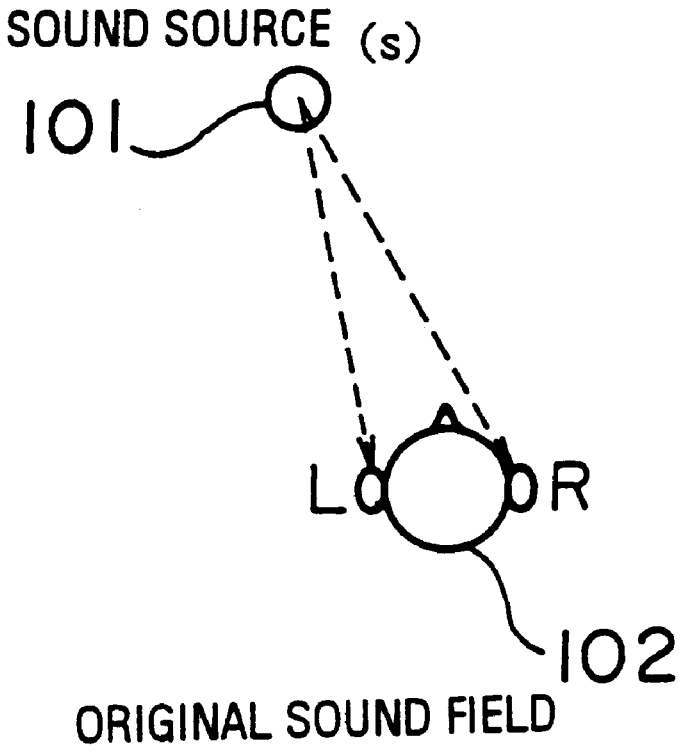
FIG. 14 is a diagram showing an example of an original sound field where a sound source and a listener are involved.
Figure 15:
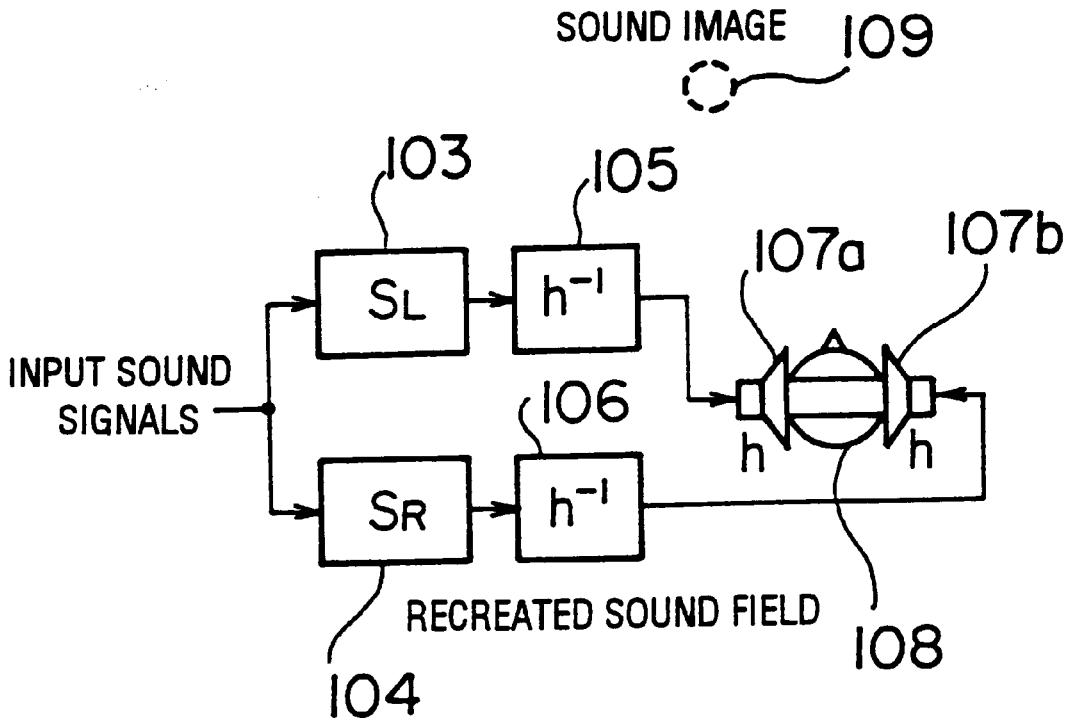
PRIOR ART FIG. 15
FIG. 15 is a diagram showing an example of a sound field recreated through a headphone by using a conventional sound processing technique.
Figure 16:
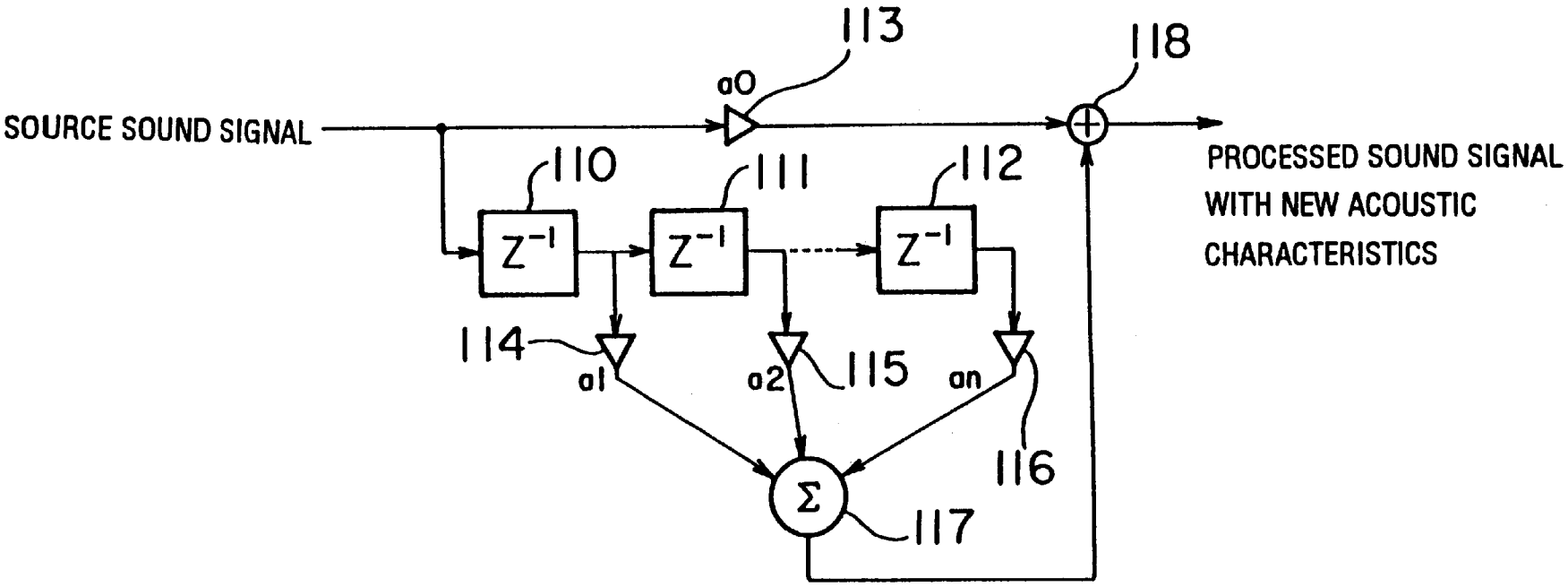
PRIOR ART FIG. 16
FIG. 16 is a diagram showing the structure of an FIR filter.
Figure 17:
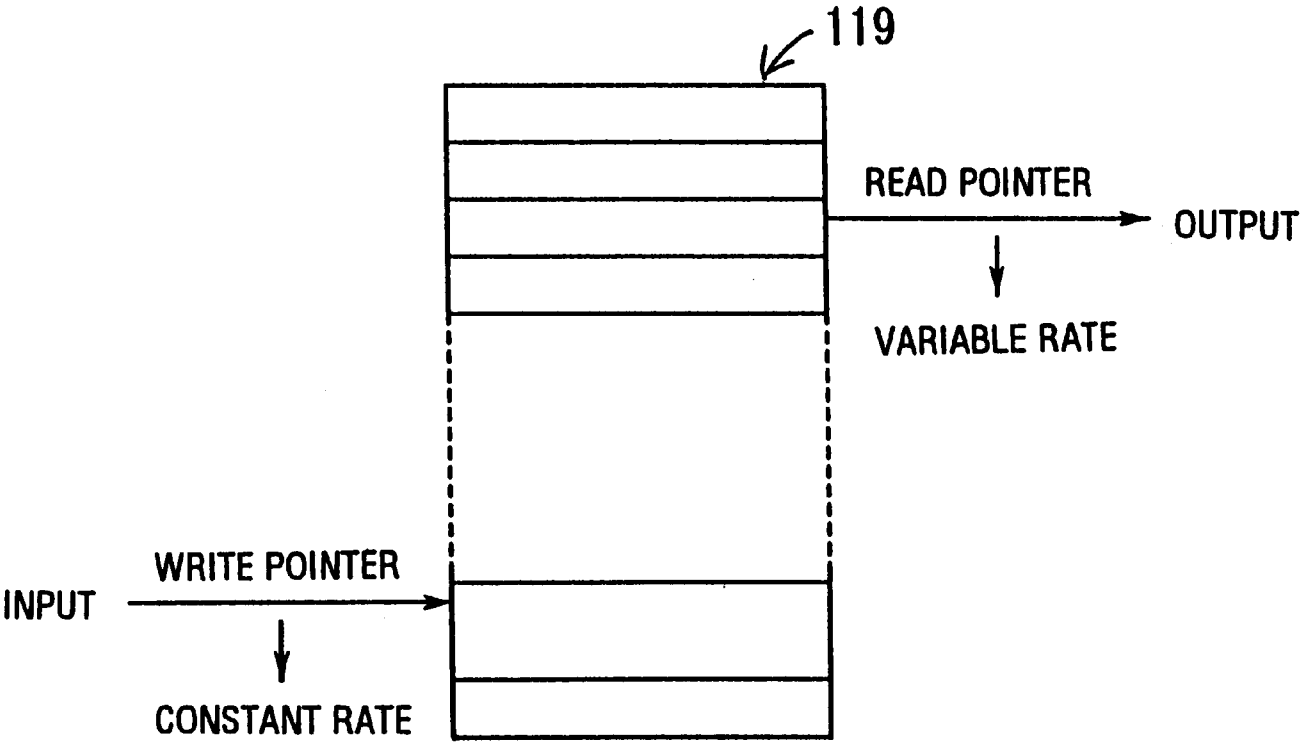
PRIOR ART FIG. 17
FIG. 17 is a diagram showing a ring buffer that stores sound data.

Referring next to FIG. 13, the following description will explain a third embodiment of the present invention where speakers are used instead of the headphone to recreate a sound field. FIG. 13 is a total block diagram of a three-dimensional sound processing system where the present invention is embodied. Since the structure of the third embodiment is basically the same as that of the first embodiment, the following description will focus on its distinct points, while maintaining like reference numerals for like structural elements.

Unlike the preceding two embodiments, the third embodiment recreates a sound field with speakers 33 and 34. A sound image positioning filter 36 comprises two filters 36*a* and 36*b* having transfer functions TL and TR expressed as the following equations (12*a*) and (12*b*), respectively. It should be noted here that the two speakers 33 and 34 are placed at symmetrical locations with respect to a listener 35.

$$T_L=(S_LL_{L-SR}L_R)/(L_L^2L_R^2) \tag{12a}$$

$$T_R=(S_RL_L-S_LL_R)/(L_L^2-L_R^2) \tag{12b}$$

where $S_L$ and $S_R$ are head-related transfer functions representing the acoustic characteristics of respective sound paths in the original sound field from the sound source to the listener's tympanic membranes, as described in the first embodiment. The symbols $L_L$ and $L_R$ are also head-related transfer functions which represent the acoustic characteristics from the L-ch speaker 33 to both tympanic membranes of the listener 35.

The head-related transfer functions $S_L$ and $S_R$ as part of the above transfer functions TL and TR are programmed into the filters 36*a* and 36*b* as a set of coefficients retrieved from the coefficient memory unit 22 for a given sound image location. Those coefficients are originally created by the filter coefficient enhancement unit in the first embodiment.

Even in such a sound field produced by the speakers 33 and 34, the improvement of sound image positioning in the F-R direction, which is what the first embodiment realized using a headphone, can be accomplished by configuring the filters 36*a* and 36*b* with the coefficients created by the filter coefficient enhancement unit in the way clarified above.

As a further variation of the first to third embodiments of the present invention, the degree of ear-to-ear difference enhancement concerning the head-related transfer functions can be controlled according to the sound image locations. Specifically, the value $\alpha_{max}$, the maximum value of $\alpha(\omega)$ in FIG. 9, will be varied according to the location of a sound image.

The above discussion will be summarized as follows. First, according to the present invention, enhancement means enhances the difference in impulse response between two sound paths reaching the listener's ears in the original sound field, thereby yielding improved positioning of a sound image in the F-R direction in the reproduced sound field.

Second, coefficient decision means determines a series of coefficient values for a low-pass filter depending on the distance between the listener and the sound image in a reproduced sound field. The degree of high-frequency component suppression is controlled according to the sound image distance from the listener. This simulates such a nature of the sound that the listener will receive a treble-reduced sound when the sound image is located far from the listener. As a result, the sound processing system according to the present invention can place recreated sound images at proper distances as they were originally heard. A simple first-order IIR filter can serve as the low-pass filter required in this system to provide the above sound effects. Therefore, the present invention makes it possible to control the distance perspective of sound images with a smaller amount of data to be processed and less memory consumption, compared with conventional systems.

Third, according to the present invention, coefficient decision means determines a series of filter coefficients for motion control, based on the speed and direction of a moving sound image. This filter works as a high-pass filter that suppresses the low-frequency components when the sound image approaches the listener, while serving in turn as a low-pass filter to suppress the high-frequency components when the sound image goes away.

In addition, the filter coefficient values are raised as the sound image moves faster, thereby increasing the degree of the suppression. Such a high-pass or low-pass filter can also be realized as a simple first-order IIR filter. In this way, the three-dimensional sound processing system of the present invention enables the distance perspective and motion of a sound image to be controlled with less data processing loads and memory consumption.

The foregoing is considered as illustrative only of the principles of the present invention. Further, since numerous modifications and changes will readily occur to those skilled in the art, it is not desired to limit the invention to the exact construction and applications shown and described, and accordingly, all suitable modifications and equivalents may be regarded as falling within the scope of the invention in the appended claims and their equivalents.

What is claimed is:

1. A three-dimensional sound processing system, comprising:

enhancement means for creating two difference-enhanced impulse responses by emphasizing a difference between two sets of acoustic characteristics represented as impulse responses measured in an original sound field concerning two spatial sound paths from a sound source to left and right tympanic membranes of a listener;

distance calculation means for calculating a distance between the sound image and the listener in the reproduced sound field;

motion speed calculation means for calculating motion speed and motion direction of the sound image, based on variations in time of the distance calculated by said distance calculation means;

coefficient decision means for determining first coefficients according to the motion speed and the motion direction which are calculated by said motion speed calculation means and for determining second coefficients for a plurality of sound source locations, based on the two difference-enhanced impulse responses created by said enhancement means, and storing the second coefficients for each one of the sound source locations; and a filter unit, configured with the first and second coefficients to provide the listener with three-dimensional sound effects by reproducing a sound image properly positioned in a reproduced sound field.

2. A three-dimensional sound processing system according to claim 1, wherein said enhancement means emphasizes the difference between the two sets of acoustic characteristics based on a difference in amplitude spectrums of the impulse responses measured in the original sound field concerning the two spatial sound paths from the sound source to the left and right tympanic membranes of the listener.

3. A three-dimensional sound processing system according to claim 1, wherein:

said filter unit comprises an infinite impulse response (IIR) filter configured with linear predictor coefficients representing poles determined through linear predictive analysis of the two difference-enhanced impulse responses, and a finite impulse response (FIR) filter configured with filter coefficients representing zeros determined by using a least square error method; and said IIR and FIR filters are connected in series to add the acoustic characteristics of the original sound field to the source sound signal.

4. A three-dimensional sound processing system according to claim 1, wherein:

said coefficient decision means determines the first coefficients according to the distance calculated by said distance calculation means; and said filter unit is configured with the first coefficients determined by said coefficient decision means according to the distance, and suppresses high-frequency components contained in the source sound signal.

5. A three-dimensional sound processing system according to claim 1, wherein said coefficient decision means determines the first coefficients so that the high-frequency components will be suppressed in proportion to the distance calculated by said distance calculation means.

6. A three dimensional sound processing system according to claim 1, wherein said coefficient decision means determines the first coefficients so that said filter unit suppresses the low-frequency components contained in the source sound signal in response to the motion direction calculated by said motion speed calculation means indicating that the sound image is approaching the listener.

7. A three-dimensional sound processing system according to claim 1, wherein said coefficient decision means determines the first coefficients so that said filter unit suppresses the high-frequency components contained in the source sound signal in response to the motion direction calculated by said motion speed calculation means indicating that the sound image is leaving the listener.

8. A three-dimensional sound processing system according to claim 1, wherein said coefficient decision means determines the first coefficients so that said filter unit enhances the suppression as the motion speed calculated by said motion speed calculation means increases.

9. A method of providing a listener with three-dimensional sound effects, comprising:

creating two difference-enhanced impulse responses by emphasizing a difference between two sets of acoustic characteristics represented as impulse responses measured in an original sound field concerning two spatial sound paths from a sound source to left and right tympanic membranes of the listener;

calculating a distance between a sound image and the listener in a reproduced sound field and a motion speed and motion direction of the sound image based on variations in time of the distance calculated;

determining first coefficients according to the motion speed and the motion direction determining second coefficients for a plurality of sound source locations, based on the two difference-enhanced impulse responses, and storing the second coefficients for each one of the sound source locations; and configuring a filter unit with the first and second coefficients to provide the listener with three-dimensional sound effects by reproducing a sound image properly positioned in a reproduced sound field.

* * * * *